United States Patent [19]

Gunby

[11] 3,988,220

[45] Oct. 26, 1976

[54] PROCESS FOR ELECTROLYZING BRINE IN A BIPOLAR ELECTROLYTIC DIAPHRAGM CELL HAVING FRICTION WELDED CONDUCTOR CONNECTOR MEANS

[75] Inventor: Leslie Gunby, Pittsburgh, Pa.

[73] Assignee: PPG Industries, Inc., Pittsburgh, Pa.

[22] Filed: Jan. 29, 1975

[21] Appl. No.: 544,987

Related U.S. Application Data

[62] Division of Ser. No. 430,977, Jan. 4, 1974, Pat. No. 3,900,384, which is a division of Ser. No. 309,310, Nov. 24, 1972, Pat. No. 3,813,326.

[52] U.S. Cl. ..... 204/98; 204/128; 204/254; 204/268; 204/280

[51] Int. Cl.[2] ..... C25B 1/16; C25B 1/26; C25B 11/10; C25B 9/00

[58] Field of Search ..... 204/254, 268, 280, 98, 204/128

[56] References Cited

UNITED STATES PATENTS

| | | | |
|---|---|---|---|
| 3,676,325 | 7/1972 | Smith et al. | 204/288 |
| 3,813,326 | 5/1974 | Gunby | 204/256 |
| 3,884,792 | 5/1975 | Mc Gilvery | 204/268 |

FOREIGN PATENTS OR APPLICATIONS

| | | | |
|---|---|---|---|
| 2,019,806 | 11/1970 | Germany | 204/286 |

*Primary Examiner*—R. L. Andrews
*Attorney, Agent, or Firm*—Richard M. Goldman

[57] ABSTRACT

A bipolar electrolytic diaphragm cell is disclosed having a low resistance conductor/connector between the cathodes of one cell and the anodes of the next adjacent cell. The conductor/connector, which penetrates through the backplate, has an anolyte-resistant member connected to the anode and a catholyte-resistant member connected to the cathode. The anolyte- and catholyte-resistant members are connected to an intermediate high conductivity member by friction welding.

5 Claims, 10 Drawing Figures

FIG. 2
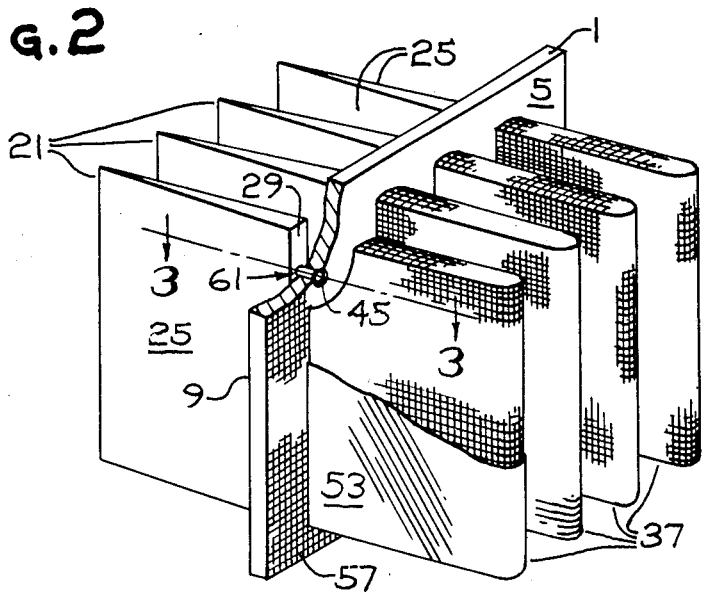
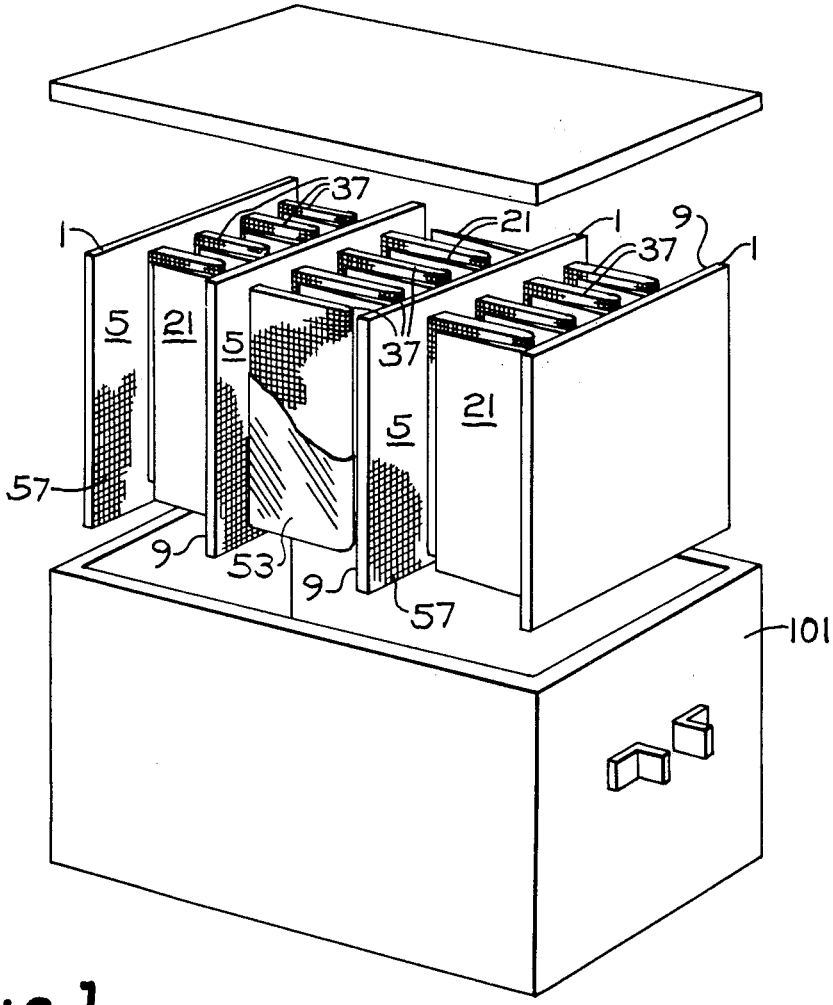
FIG. 1

PROCESS FOR ELECTROLYSING BRINE IN A BIPOLAR ELECTROLYTIC DIAPHRAGM CELL HAVING FRICTION WELDED CONDUCTOR CONNECTOR MEANS

This is a division of application Ser. No. 430,977, filed Jan. 4, 1974 now U.S. Pat. No. 3,900,384, which in turn is a division of U.S. Application Ser. No. 309,310, filed Nov. 24, 1972, now U.S. Pat. No. 3,813,326.

BACKGROUND OF THE INVENTION

Bipolar electrolytic diaphragm cells, useful in the electrolysis of brines, e.g., aqueous solutions of alkali metal halides such as sodium chloride, have a plurality of individual electrolytic cells in bipolar mechanical and electrical configuration. The structure for effecting bipolar mechanical and electrical configuration is an electroconductive, electrolyte-resistant backplate separating the adjacent cells from one another, and serving as a structural member for the cathodes of one cell and the anodes of the next adjacent cell in the bipolar electrolyzer.

The backplate has three functions. First, the backplate separates the catholyte of one cell from the anolyte of the next adjacent cell of the electrolyzer. Second, the backplate is a conductive member connecting the cathodes of one electrolytic cell and the anodes of the next adjacent cell in the electrolyzer, thereby providing bipolar electrical configuration between the cathodes of one cell and the anodes of the next adjacent cell in the electrolyzer. Third, the backplate acts as a common structural member, having cathodes extending substantially perpendicularly from one side and anodes extending substantially perpendicularly from the other side, thereby providing bipolar mechanical configuration.

In the design and construction of bipolar diaphragm electrolyzers, it is particularly important to conduct current from the cathodes of the one cell to the anodes of the next adjacent cell with the minimum voltage drop between cells. This voltage drop is a combination of IR voltage drop and contact resistance voltage drop. This minimization of voltage drop must be accomplished with the minimum of seepage of electrolyte through the backplate from the electrolyte of one cell to the electrolyte of the adjacent cells. The minimization of IR drop through the backplate and the minimization of contact resistance between the cathodes of one cell and the anodes of the next adjacent cell while maintaining the structural integrity of the backplate, are particularly important goals. This is because a typical electrolyzer may contain a plurality of cells, for example, from 3 to 8 or 11 or more cells, for example, as many as 70 or 80 cells. Additionally, electrolyzers are frequently connected in series, thereby providing as many as three or four hundred individual cells in a series. Bipolar electrolyzers frequently operate at high currents; for example, 70,000, 100,000, or even 150,000 amperes. Thus, it can be seen that a voltage reduction of only ten one-thousandths of a volt per cell may result in an overall voltage savings of 3 or more volts across an entire cell circuit and a power savings of as much as three hundred kilowatts across the entire cell circuit.

Early attempts to conduct current from the cathode of one cell to the anode of the next adjacent cell in an electrolyzer with minimum IR and contact resistance voltage drops and substantially no seepage of electrolyte between electrolytic cells generally required means for conducting electricity from a cathode of one cell through the backplate to an anode of the next adjacent cell, and for connecting the anode and cathode to the backplate, which breached the backplate. Such conductor/connectors had a conductive material, for example, copper, sheathed in a catholyte-resistant metal, such as steel, on one side of the copper, and an anolyte-resistant metal, such as titanium, on the other side of the conductor. The titanium sheathing was typically silver welded to the copper conductor using a 99.99 percent pure silver filler, and the steel sheathing was typically welded to the copper conductor using a copper-silicon filler metal. The silver welded joints were characterized by high cost, and a substantial degree of non-reproductibility, thereby necessitating 100 percent inspection of all of the joints. Furthermore, the means provided for complete inspection of all soldered joints were themselves subject to occasional failure, allowing electrolyte to attack the copper conductor, raising the voltage drop across the cell, and ultimately leaking into the electrolyte of the adjacent cell, and causing failure of the conductor/connector.

SUMMARY OF THE INVENTION

It has now been found that a means, hereinafter called a conductor/connector, for conducting electricity from a cathode of one cell through a common backplate to an anode of the next adjacent cell, and connecting the anode and cathode to the common backplate, where both an anolyte-resistant member, and a catholyte-resistant member, including sheathing, are friction-welded to an intermediate member of high conductivity, provides a particularly outstanding conductor/connector. Friction-welded conductor/connectors are characterized by the absence of a third phase between the joined pieces, a high degree of reproducibility of the voltage drop across the conductor/connector, and a considerable cost savings in fabrication. Additionally, the friction-welded conductor/connector is substantially less subject to attack by electrolyte than the silver welded conductor/connectors, and may be prepared at significantly lower cost.

According to this invention, a conductor/connector is provided having a copper current-conducting member. At one end of the current-conducting member, the anodic end, is a friction-welded member of an anolyte-resistant metal. At the other end of the conductor/connector, the cathodic end, is a catholyte-resistant member which also extends along the sides of the copper conductor as a sheath or sleeve to protect the copper from the catholyte.

DESCRIPTION OF THE INVENTION

Specific exemplifications of the invention disclosed herein may be more fully understood by reference to the Figures.

FIG. 1 is an exploded, isometric, schematic drawing of a bipolar electrolytic diaphragm cell, showing the relationship of the backplate to the individual cells.

FIG. 2 is an isometric, partial cutaway drawing of a backplate of a bipolar diaphragm electrolytic cell showing the anodes, the cathodes, and the conductor/-connector.

Figure 4A:
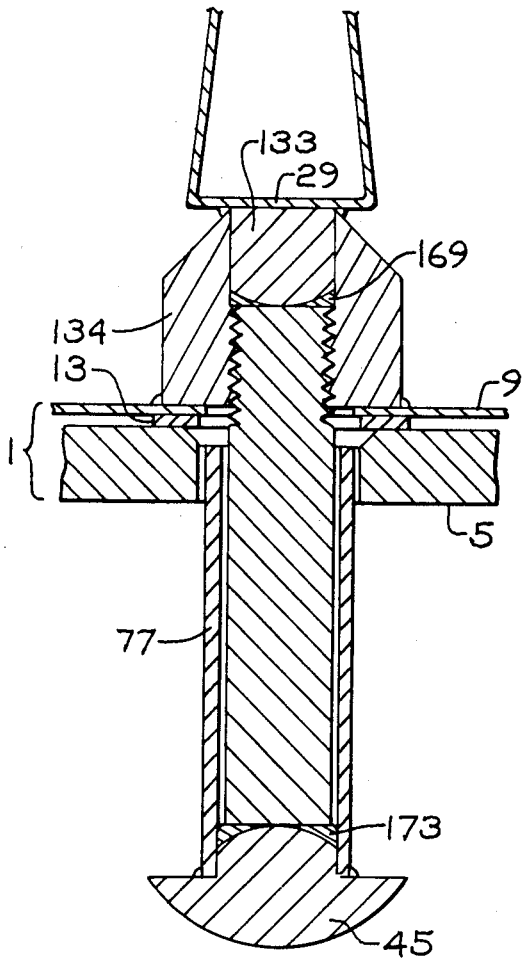
Figure 4B:
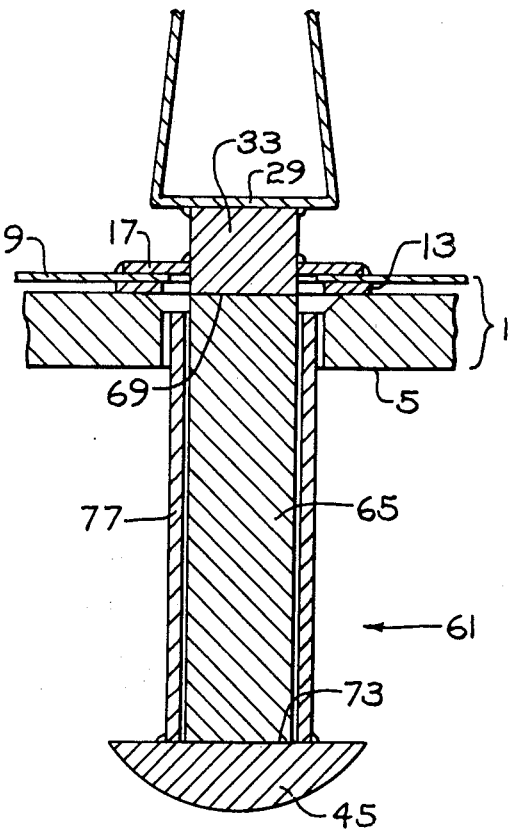
Figure 5A:
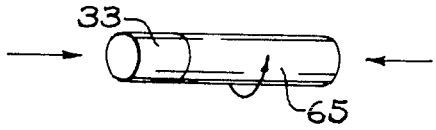
Figure 5B:
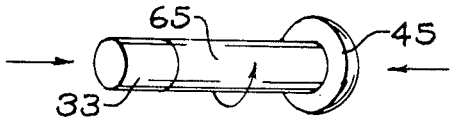
Figure 5C:
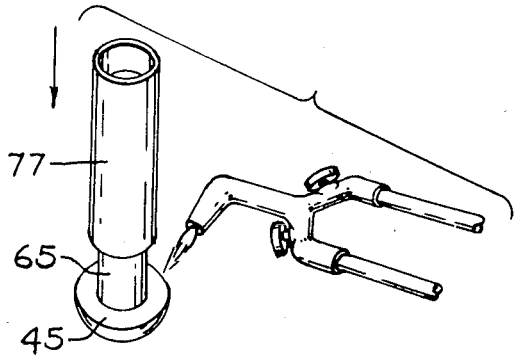
Figure 5D:
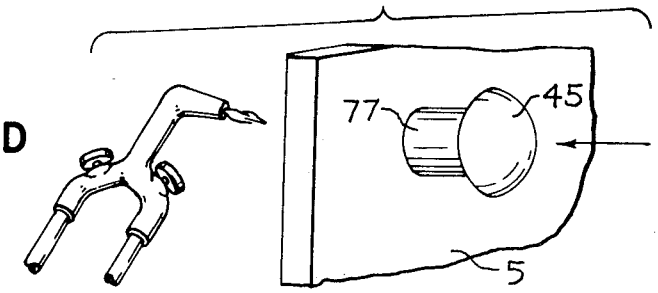
Figure 5E:
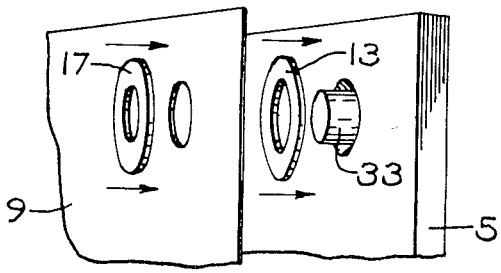

FIG. 4 A and B is a cutaway drawing showing a side-by-side comparison of the conductor/connector described in the prior art and a conductor/connector of the type described herein.

FIG. 5A–5E is a schematic flow diagram for a method of preparing a backplate for a bipolar electrolyzer according to the method described herein.

A typical bipolar electrolytic diaphragm cell is shown in schematic exploded view in FIG. 1. The cell has a cell box, (101) containing the individual electrolytic cells. While a single cell box is shown, there may alternatively be a plurality of individual cell boxes. For purposes of illustration, three cells are shown inside the cell box. Each of the individual bipolar cells has a backplate (1) with a cathodic surface (5) of a catholyte-resistant metal and an anodic surface (9) of an anolyte-resistant material. Extending perpendicularly from the cathodic surfaces (5) of the backplate (1) are cathodes (37). Extending perpendicularly from the anodic surfaces (9) of the backplate (1) are anodes (21). The anodes are interleaved between the cathodes (37) of the next backplate.

Figure 3:
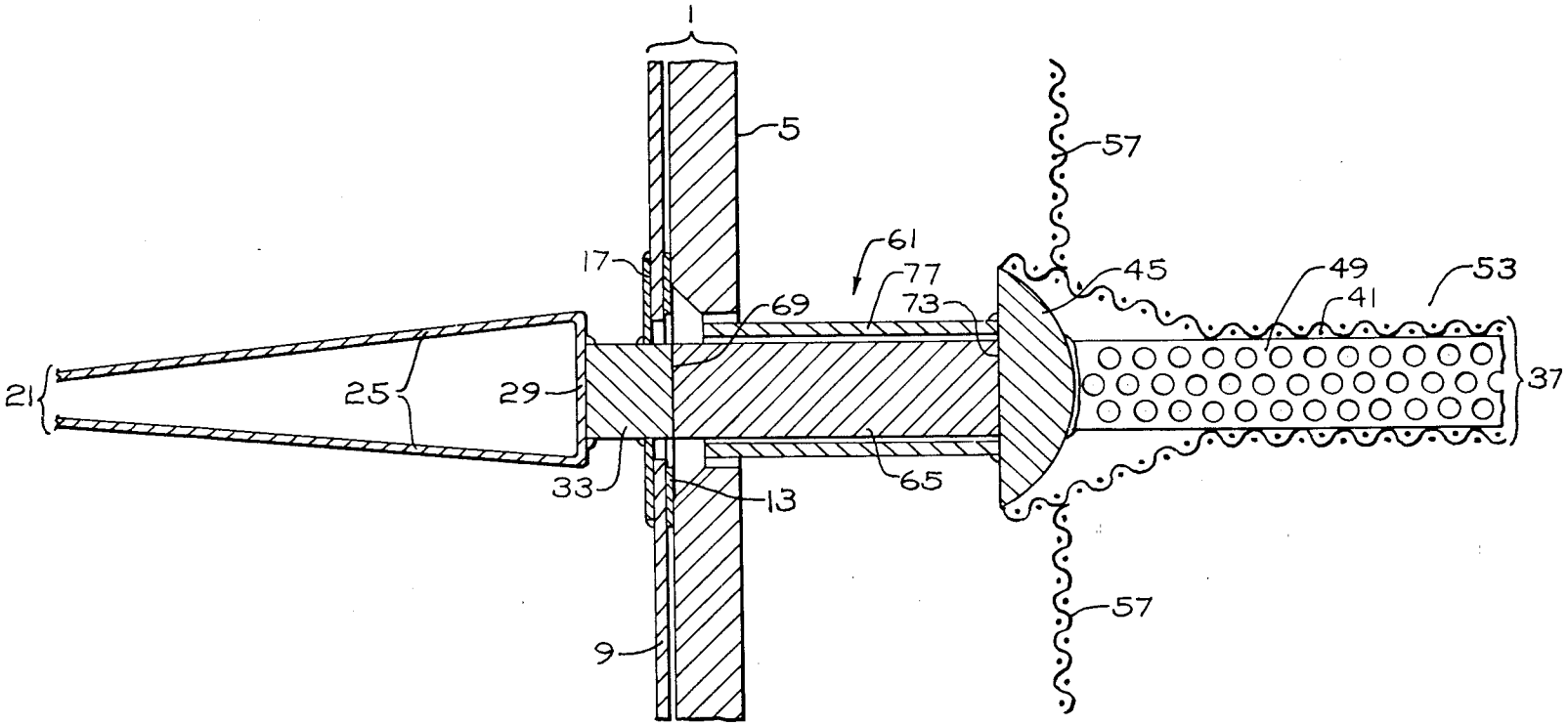
FIG. 3 is a cutaway drawing along plane 3—3' of FIG. 2 showing the backplate, the conductor/connector, a cathode and an anode.

FIG. 2 is an isometric, partial cutaway view of a single backplate of an electrolytic cell, and FIG. 3 is a cutaway along plane 3—3′ of FIG. 2. The backplate has anodes (21) and cathodes (37) connected thereto. The backplate (1) has a cathodic surface (5) and an anodic surface (9) as described above. The cathodes (37) extend from the cathodic surface (5) of the backplate (1), and have mesh fingers (41) covered with a diaphragm (53). The diaphragm may be an asbestos diaphragm, an electrolyte-permeable resin, or a permionic membrane. The cathodes (37) are supported on a steel base (45) which is bonded to the conductor/connector (61) and have a reinforcing member (49) to prevent collapse during diaphragm pulling. A cathodic backscreen (57), also covered with a diaphragm (53), separates the individual cell into anolyte and catholyte compartments. The backscreen (57) is mounted on the backplate (1) of the cell on the cathodic side (5) thereof.

The anodes (25) are connected to the anolyte surface (9) of the backplate (1). The anodes (21) extend perpendicularly from the backplate and are interleaved between the cathodes of the next adjacent backplate in the series as shown in FIG. 1 above. The anodes themselves may either be graphite anodes or they may be of the metal type known in the art as dimensionally-stable anodes. Such dimensionally-stable anodes have an electroconductive surface, e.g., a platinum group metal, an oxide of a platinum group metal, an anolyte-resistant conductive oxide of a metal, an anolyte-resistant, conductive oxide of several metals, or the like, on a valve metal base. The valve metals are those metals which form a non-conducting oxide which is resistant to the anolyte when exposed to the anolyte. The valve metals include titanium, zirconium, hafnium, vanadium, niobium, tantalum, and tungsten. The anodes are typically in the form of blades (25) and a base (29). The blades (25) may be perforate or foraminous. The anodes may be a single blade between two cathode fingers or two blades interposed between a pair of cathode fingers. In the case of two blades (25) interposed between a pair of cathode fingers (41), the anode blades (25) may be coated on only the surfaces facing the cathodes (45), or only on the surfaces within the anode between the two anode blades, or on both sets of surfaces. The anode base (29) is bonded to a conductor (33) of the conductor/connector (61).

In FIG. 2, the conductor/connector (61) is shown extending through the backplate (1) bonded to the steel base (45) of the cathode (41) and the conductor (33) at the base of the anode (29).

The conductor/connector is shown in more detail in FIG. 3. The conductor/connector (61) breaches the backplate (1) of the electrolytic cell. In one preferred exemplification, the conductor/connector (61) has a cylindrical copper stud (65) extending through the center thereof. On the anodic side of the copper stud (65) is an anolyte-resistant conductor (33). On the cathode side of the copper studs (65) is a catholyte-resistant member (45).

The bond between the anolyte-resistant member (33) of the conductor/connector (61) and the copper member (65) typically has a conductivity of greater than $1.5 \times 10^4$ mho when measured by leads one half of an inch from the bond in a 0.75 inch diameter piece. Generally, the conductivity is between $1.6 \times 10^4$ and $5.0 \times 10^4$ mho, and most frequently, the bond has a conductivity of from about $3.0 \times 10^4$ mho to about $3.6 \times 10^4$ mho, although conductivities of as high as $10^5$ mho or even higher may be attained.

Thus, according to this invention, a conductor/connector is provided having a voltage drop of less than 25 millivolts at a current flow of 400 to 500 amperes. The bond is further characterized by the complete absence of a slag, solder, or welding flux containing third phase between the anolyte-resistant member (33) and the copper member (65). The bond is also characterized by the substantial absence of a third phase containing an alloy or intermetallic compound of copper and the metal used in fabricating the anolyte-resistant member (33). Such an alloy or intermetallic compound-containing phase if present at all, is not detectable by optical examination at 1000 magnification.

As will be described more fully hereinafter, in a preferred exemplification of this invention the anolyte-resistant member (33) is friction-welded to the copper stud (65). The catholyte-resistant member (45) may be friction-welded to the copper stud (65) or it may be bonded thereto by another means.

A catholyte-resistant sheave or sleeve (77) shields the copper stud (65) from contact with the catholyte. The sheave or sleeve (77) may be friction-welded to the catholyte-resistant member (45), or it may be bonded thereto by other means.

While the copper conductor (65) is spoken of and illustrated as being a cylindrical stud, other geometries may be used. Thus, the copper conductor (65) may be a machined hexagonal or rectangular stud.

According to one preferred method of utilizing the conductor/connector of this invention, the sheathed conductor/connector (61) is placed through an opening in the catholyte-resistant member (5) of the backplate (1) with the sheath inserted to a depth sufficient to provide some rigidity to the conductor/connector (61). The sheath is welded to the backplate. A concentric member (13) such as a copper washer, fits in contact with the backplate and concentric with the center-line of the conductor/connector (61), although not necessarily contacting the anolyte-resistant member (33). The anolyte-resistant member (9) of the backplate (1) fits around the anolyte-resistant member (33) of the conductor/connector (61), separated from the catholyte-resistant member (5) of the backplate (1) by the concentric member (13). The concentric member (13) serves to separate the anolyte-resistant member (9) of the backplate (1) from the catholyte-resistant member (5) of the backplate (1) in order to allow for the recombination of atomic hydrogen evolved at the catholyte surface of the catholyte-resistant member (5) of the backplate (1) which atomic hydrogen thereafter permeates through the catholyte-resistant member of the backplate, as more fully described in the commonly assigned application of Carl W. Raetzsch et al., Ser. No. 158,695, filed July 1, 1971 for an Electrolytic Cell.

The anolyte-resistant member (9) of the backplate (1) may be bonded to the anolyte-resistant member of the conductor/connector (61) by any means known in the art such as butt welding, resistance welding, flash welding, heliarc welding, or the like. Or, as shown in the Figures, the anolyte-resistant member (33) of the conductor/connector (61) may be bonded to an anolyte-resistant concentric member (17) which is in turn bonded to the anolyte-resistant surface (9) of the backplate (1).

FIG. 4 is a side-by-side comparison of the conductor/connector of the prior art and one exemplification of the conductor/connector described herein. Both the prior art conductor/connector and the conductor/connector described herein are shown in combination with a backplate (1) having a cathodic (5) and an anodic surface (9) separated from the cathodic member (5) by a copper washer (13). At the cathodic end of both conductor/connectors is a steel cathode base (45). At the anodic end of both conductor/connectors is an anode base (29) which is bonded to an anolyte-resistant conductor (33) and (133) in both the conductor/connector described herein and the conductor/connector of the prior art.

Both the prior art conductor/connector and the conductor/connector described herein have a copper stud (65) encased in a catholyte-resistant sleeve or sheath (77) which sleeve or sheath is bonded to the catholyte-resistant member (5) of the backplate (1). Both the prior art conductor/connector and the conductor/connector described herein are bonded to the anolyte-resistant member (9) of the backplate (1). As shown in FIG. 4, this may be accomplished by bonding the anolyte-resistant member (33) of the conductor/connector (61) to an anolyte-resistant concentric member (17) such as titanium washer, which concentric member (17) is then bonded to the anolyte-resistant surface of the backplate.

In the conductor/connector of the prior art, the anolyte-resistant member (134) is an anolyte-resistant nut which is bolted to a threaded copper stud (65). It has been found that in order to obtain satisfactory conductivity, the anolyte-resistant titanium nut (134), after being bolted to the copper stud, must be silver welded thereto. The anolyte-resistant nut cap (133) is titanium welded or otherwise suitably bonded to the titanium nut (134). On the cathodic side of the prior art conductor/connector, the copper stud (65) is welded to the catholyte-resistant sleeve (77) and the catholyte-resistant sleeve (77) is silver welded (143) to the catholyte-resistant member (45).

The exemplification of the conductor/connector described herein is shown in the right hand side of FIG. 4. As can be seen therein, the anolyte-resistant conductors (33) and copper studs (65) have an interface (69) therebetween. This interface is the site of the friction weld. There is also an interface between the copper stud (65) and the catholyte-resistant member (45). This interface (73) may be provided by conventional welding techniques, or by friction welding. In a preferred exemplification of this invention, the bond at the interface (73) between the copper stud (65) and the catholyte-resistant member (45) is provided by a friction welding. A friction welded copper-titanium typically has a resistance of from about $28 \times 10^{-6}$ ohm to about $30 \times 10^{-6}$ ohm when tested by applying probes 0.5 inch on either side of the joint on a 0.75 inch diameter piece. There is also a joint between the sleeve or sheath (77) and the catholyte-resistant member (45). This joint may be provided by friction welding or by other bonding methods.

Conventional means of welding do not provide a satisfactory bond between copper and titanium. Conventional flux welding techniques and molten metal welding techniques provide an undesirable third phase characterized by a high degree of non-reproducibility of the electrical resistivity and a marked decrease in strength. One way to overcome these difficulties in providing a suitable titanium to copper bond is to utilize welding techniques with filler wire characterized by a high electrical conductivity, such as silver filler wire. However, such silverwelded copper-titanium joints are not readily reproducible, and do not have constant voltage drop from joint to joint.

Satisfactory, high conductivity welds of copper to titanium are provided by welding techniques characterized by the substantial absence of either a flux or of a molten metal phase during welding. Such techniques include friction welding, ultrasonic welding and detonation welding. Friction welding, also known as inertial welding, is particularly satisfactory for providing a high conductivity copper-titanium joint. The copper-titanium joint is characterized by a high degree of reproducibility of the electrical conductivity from weld to weld, and requires a lower degree of quality control than copper-titanium bonding techniques of the prior art. Friction welding makes use of the frictional heat generated at the forging surfaces of two work pieces, when the two work pieces are revolved relative to one another and then pressed against one another. The speed of revolution and the imposed pressure are such as to evolve sufficient heat to raise the temperature of the two work pieces above the extrusion or softening temperature of the work pieces, thereby plasticizing the butting areas or forging surfaces, but below the melting temperatures of the work pieces, thereby avoiding the formation of a liquid phase. When the butting areas become plastic, or extrudable, the rotational force, or torque, is halted and the imposed pressure increased to form a joint.

The friction-welded joint is characterized by the existence of a "collar" of extruded metal around the joint. Additionally, the completed work piece is characterized in that its length is less than the sum of the original length of the two work pieces. This diminution in length, which occurs during the formation of the "collar" is called the "upset".

Friction welding, for example of copper to titanium, or of steel to copper, is a three-stage process. Each stage is characterized by a distinctive torque, feed pattern, and temperature pattern.

The first stage of friction welding is evidenced by a low torque and increasing temperature. The onset of the second stage is evidenced by a trend of unevenly increasing torque and increasing temperature. During the second stage the torque reaches a maximum. The third stage is evidenced by "upset" as the collar forms around the weld.

These three stages are described in the literature, e.g., T. T. Houldcroft, *Welding Progress*, Cambridge University Press, (1967), pp 178 to 182; F. Koenigsberger and J. R. Adair, *Welding Technology*, Third Edition, MacMillan Company (1966), pp 182 to 192; and V. I. Vill, *Theory of Friction Welding*, American Welding Society Translation, (1962).

The first stage is reported in the literature as being characterized by the collision and erosion of high spots, the rupturing of oxide films such as the $TiO_2$ film, and metal to metal contact as the rotating bodies are subjected to dry friction. The second stage, a stage of unevenly increasing torque, is reported as being characterized by "seizure," i.e., the formation of metal to metal bonds, and "shear," i.e., the breaking of these metal bonds. According to the literature, the siezure or making of the metal to metal bonds transforms the kinetic energy into chemical energy (heat of formation), while the "shear" or breaking of the bonds transforms the chemical energy into sensible heat, which in turn heats the work pieces. In this way, the second stage is a stage of increasing temperature of the forging surfaces. The third stage, characterized by upset and the formation of the collar, is described in the literature as occurring when the temperature is high enough that the compressive strength becomes less than the imposed "shear." In this stage, the temperature of the work pieces is below the melting temperature of the lower melting of the two work pieces, but above their extrusion or softening temperatures.

During the third stage, the actual welding of the titanium and copper occurs. In the friction welding of titanium to copper, a large upset, e.g., from about 0.050 inch to about 0.100 inch is preferred. Upsets of a lesser amount, e.g., less than about 0.025 of an inch, while satisfactory in providing a physically strong weld, may not remove all of the oxide from the interface, and may therefore provide a lower conductivity. Upsets of greater than about 0.125 inch, while not deleterious, do not sufficiently improve the conductivity or mechanical strength in order to justify the additional torques or imposed pressures necessary therefor.

During the first two stages of friction welding, increasing the rotational velocity decreases the time necessary to attain the onset of the third stage. Similarly, decreasing the angular velocity increases the time necessary to attain the onset of the third stage.

While the duration of the third stage is reported in the literature as being essentially independent of the rotational velocity, the quality of the weld is reported to be a function of the rotational velocity during the third stage. Too low a rotational velocity may result in a weld at a periphery only and not at the center of the surfaces to be welded. This is because frictional welding starts at the perimeter of the surfaces to be friction welded and works toward the center. A complete weld, through to the center, requires a high rotational velocity.

In the friction welding of copper to titanium, particularly good results are obtained if the rotational velocity is from about 1000 to about 5000 revolutions per minute and generally from about 2000 to about 3000 revolutions per minute, and especially about 2500 revolutions per minute. Particularly good results are obtained when the imposed pressure is from about 5000 to about 15,000 pounds per square inch and especially about 10,000 pounds per square inch during the first two stages. In the friction welding of titanium to copper, upset may occur without an increase in pressure during the third stage.

While the above pressures and rotational velocities are optimum ranges thereof, the determination of particular pressures and rotational velocities within these ranges are matters of mere routine testing. With respect to the upper ranges of rotational velocity, the process of friction welding is reported to be essentially self-regulating. That is, if the rotational velocity is too high and a molten metal film is formed, the molten metal, having a lower coefficient of friction, acts as a lubricant, cooling and ultimately resolidifying.

Fig. 5 shows a schematic flow chart for a method for preparing a backplate according to the method of this invention. As shown therein, a copper stud (65) is friction welded to a titanium member (33) as described hereinbefore. Thereafter, a catholyte-resistant member (45) such as a steel cap or stud is bonded to the opposite surface of the copper stud. This may be either by conventional copper-iron welding techniques, or alternatively, by friction welding. Thereafter, the catholyte-resistant sleeve or sheath (77) is slid over the copper and titanium stud and bonded to the catholyte-resistant member, e.g., a steel cap (45). This may be by friction welding or by conventional steel welding techniques.

The conductor/connector (61), a copper stud (65) with a steel cap (45) and sheath (77) bonded to one end thereof, and a titanium stud (33) friction welded to the other end thereof, is inserted in the steel member (5) of the backplate (1), with the catholyte-resistant cap (45) and sleeve (77) protruding through the cathodic surface (5) of the backplate. The sleeve (77) is welded to the backplate (1), for example, with a weld of the type shown in FIG. 3 hereinabove. A fitting (13) such as a copper washer is then placed around the conductor/connector on the opposite side thereof in contact with the opposite surface of the cathodic member of the backplate (1). The anolyte-resistant member (9) of the backplate (1) is placed on the catholyte-resistant member (5) of the backplate with the conductor/connector (61) protruding through an opening in the anolyte-resistant member (9) of the backplate (1). Thereafter, an anolyte-resistant fitting such as a titanium washer (17) of FIGS. 3 and 4 is welded to the titanium stud thereby holding the anolyte-resistant (9) and the catholyte-resistant (5) members of the backplate (1) in compression.

While FIG. 5 illustrates one order of assembling the conductor/connector, other orders of assembly may be followed. For example, the sheath or sleeve (77) and the copper stud (65) may be friction welded to the catholyte-resistant member (45) simultaneously. The anolyte-resistant member (33) may be friction welded to the copper stud (65) either before or after the sheath or sleeve (77) and catholyte-resistant member (45) have been welded to the copper stud (65).

It should be noted that various elements of the backplate (1) having two distinct members, the steel sheath or sleeve (77) may be welded to either the cathode-facing surface of the catholyte-resistant member, or to the anolyte-facing surface of the catholyte-resistant member, or to both surfaces. Additionally, the sheath or sleeve (77) may extend the full depth of the catholyte-resistant member or only to the cathode-facing surface of the catholyte-resistant member, or to an intermediate length therein. The sheath (77) of the conductor/-connector (61) may be welded directly to the catholyte-resistant member of the backplate (1), or alternatively, it may be welded or bonded to a washer-type fitting, which is in turn welded or suitably bonded to the catholyte-resistant member of the backplate. The washer or spacer between the catholyte-resistant member of the backplate (5) and the anolyte-resistant member (9) may be dispensed with, and the two members (5) and (9) of the backplate (1) may be in direct physical contact with each other.

According to another exemplification of this invention, the backplate may be a bonded steel-titanium backplate fabricated from "DETACLAD" (Trademark) as described in U.S. Pat. No. 3,137,937 to Cowan et al. In such a case, the sleeve or sheath (77) would only extend a fraction of the depth of the backplate.

Additionally, the anolyte-resistant member (33) of the conductor/connector (61) may be bonded directly to the anolyte-resistant member of the backplate (9) or it may be bonded to an anolyte-resistant fitting (17) which is in turn bonded to the anolyte-resistant member (9) of the backplate (1). The anodes may be bonded directly to the anolyte-resistant member (33) of the conductor/connector, or there may be an intermediate member therebetween, such as an anode bar or an anode base member. Similarly, the cathodes (37) may be bonded directly to the catholyte-resistant member (33) of the conductor/connector (61), or the cathodes (37) may be bonded to the cathode bars, cathode connectors, cathode bases or the like, which are in turn bonded to the catholyte-resistant member of the conductor/connector of this invention.

After assembly of either the individual conductor/-connector, or of an entire backplate, quality control may be exercised by measuring the voltage drop. At a current load of 400 to 500 amperes across the conductor/connector the voltage drop should be less than 25 millivolts.

While this invention has been described with particular reference to bipolar chlor-alkali electrolytic diaphragm cells, its use is not intended to be so limited thereby. Friction welded conductor/connectors of two dissimilar metals, e.g., titanium and copper, may be used in any bipolar electrolytic cell having dissimilar electrolytes separated by a diaphragm or membrane wherein a high conductivity between two dissimilar metals is necessary. For example, the conductor/connector of this invention may be used in bipolar fuel cells having a membrane separating the anodic compartment from the cathodic compartment of one cell and requiring a conductor having anolyte-resistant and catholyte-resistant faces for connecting one set of electrodes of opposite polarities in the next adjacent cell through a common backplate. Friction welded conductor/connectors may also be used in bipolar electrolytic cells, generally, such as electrolytic cells for the production of sodium chlorate.

The following Example is illustrative.

EXAMPLE 1

A pilot plant bipolar diaphragm electrolyzer containing two bipolar backplates is constructed to test the effects of different types of conductor/connectors. Each individual diaphragm cell has a backplate which is a 1.00 inch thick Type A-36 steel plate functioning as a cathodic member and a 0.040 inch thick titanium sheet functioning as an anodic surface. The cathodic member is separated from the anodic member of the backplate by a 1/16 inch thick copper washer between the titanium member and steel member. The anodes are expanded mesh A.S.T.M. B265 Grade One titanium having a platinum-iridium surface thereon. The cathodes are A.I.S.I. 1005 steel, 6 × 6 mesh 3/16 inch double crimped 13 guage wire calendered to 5/32 inch thick. The cathodes have identical asbestos diaphragms pulled from Johns-Manville type 3T–4T asbestos aged in a cell liquor solution.

In one electrolytic cell, the conductor/connectors are of the type shown as representative of the prior art on the left hand side of FIG. 4, having a 3.8125 inch long by 0.75 inch diameter copper conductor threaded at the anode end thereof. The threading is 10 UNC threads per inch for 1.0 inch. The conductor/connector has a steel sleeve on the cathode end and a 1/4 inch thick by 1.0 inch wide by 6 inch long steel bar silver-welded to the open end of the sleeve.

This procedure is followed with all of the conductor/-connectors. The conductor/connectors are welded into openings in the backplate prior to assembling the nut and cap. Then the copper washer is placed on the opposite surface of the steel member of the backplate and the 0.040 inch thick titanium sheet is placed against the copper washer. After assembly an A.S.T.M. B265 Grade One titanium nut is bolted to the threaded copper stud and silver welded thereto. The nut is also titanium welded to the titanium sheet using a titanium filler wire. A titanium cap is then titanium welded to the open end of the titanium nut. At a current of 408 amperes through the conductor/connector, the voltage drop across the welded conductor/connector is 15.2 millivolts. The anodes and cathodes are then welded to the conductor/connectors.

Another backplate for an electrolytic cell is prepared having friction welded conductor/connectors between the cathode of one cell and the anode of the next adjacent cell. The conductor/connectors have a 0.5 inch diameter by 3.4375 inch long copper stud friction welded to a 0.8 inch diameter by 0.375 inch long A.S.T.M. B265, Grade One titanium cap. The friction welding of the titanium to the copper is conducted at a rotational velocity of 2500 revolutions per minute and a forge pressure of 10,000 pounds per square inch. An upset of about 0.075 inch is obtained.

A Type A-36 steel bar ¼ inch thick by 1 ⅛ inches wide by 6 inches long is friction-welded to the opposite surface of the copper rod. Thereafter, a steel sleeve is friction welded to the steel bar providing a catholyte-resistant surface around the copper member of the conductor/connector. This procedure is followed with all of the conductor/connectors. The voltage drop across the friction welded conductor/connector is 14.4 millivolts at 408 amperes.

The conductor/connectors are then welded into openings in the backplate, a copper washer is placed on the opposite surface of the steel member of the backplate and the 0.040 inch thick titanium sheet, as described above, is placed against the steel member of the backplate. A titanium washer is then placed around the titanium member of the conductor/connectors and welded thereto and to the backplate by titanium welding. The anodes and cathodes are welded to the conductor/connector as described hereinabove.

The electrolyzer is then assembled and electrolysis is commenced with a brine feed containing about 310 grams per liter of sodium chloride being fed to the electrolytic cell.

Although the invention has been described with reference to particular specific details and contains preferred exemplifications, it is not intended to thereby limit the scope of this invention except insofar as the details are recited in the appended claims.

I claim:

1. In a method of electrolyzing brine in a bipolar electrolyzer having a plurality of electrolytic cells in bipolar electrical and mechanical configuration wherein an electrical current is caused to pass from an anode of one electrolytic cell to a cathode of said cell, and from said cathode through a backplate to an anode of the next adjacent cell in the electrolyzer, the improvement wherein the electrical current flowing from said cathode to said anode flows through a conductor passing through said backplate, said conductor comprising:

a copper stud;

a catholyte-resistant steel member friction welded to one end of said copper stud; and an anolyte-resistant titanium member friction welded to the opposite end of said copper stud, the bond between said anolyte-resistant member and said copper stud having an electrical conductivity of greater than about $1.5 \times 10^4$ mho and having substantially no third phase between the copper stud and the anolyte-resistant member.

2. The method of claim 1 wherein an anode is bonded to said anolyte-resistant member.

3. The method of claim 1 wherein a cathode is bonded to said catholyte-resistant member.

4. In a method of electrolyzing brine in a bipolar electrolyzer having a plurality of electrolytic cells in bipolar electrical and mechanical configuration wherein an electrical current is caused to flow from an anode of one electrolytic cell of the electrolyzer to a cathode of said cell and from the cathode of said cell through a backplate to an anode of the next adjacent cell in the electrolyzer, the improvement wherein the electrical current flowing from the cathode of one cell to the anode of the next adjacent cell flows from said cathode through a conductor to the anode, said conductor passing through said backplate and comprising a catholyte-resistant steel member, a copper stud friction welded to said catholyte resistant steel member, and a titanium member friction welded to the opposite end of said copper stud.

5. The method of claim 4 wherein the voltage drop across said conductor/connector is less than 25 millivolts at a current flow of 400 to 500 amperes.

* * * * *